United States Patent [19]

Hoven

[11] 4,327,300

[45] Apr. 27, 1982

[54] HELICAL SLIDING DRIVE STARTER

[76] Inventor: Wilhelm Hoven, Grüner Weg 43, D-51 Aachen, Fed. Rep. of Germany

[21] Appl. No.: 968,683

[22] Filed: Dec. 12, 1978

[30] Foreign Application Priority Data

Dec. 14, 1977 [DE] Fed. Rep. of Germany ..... 2755704

[51] Int. Cl.[3] ..... F02N 11/00

[52] U.S. Cl. ..... 310/75 C; 310/78; 74/7 C; 74/7 R

[58] Field of Search ..... 74/6, 7 R, 7 C; 310/75, 310/75 C, 78

[56] References Cited

U.S. PATENT DOCUMENTS 2,939,324 6/1960 Gilbert et al. ..... 74/7 C 3,686,961 8/1972 Campbell ..... 74/7 R

*Primary Examiner*—Donovan F. Duggan

*Attorney, Agent, or Firm*—Thompson, Birch, Gauthier & Samuels

[57] ABSTRACT

A helical sliding drive starter with a freewheel unit having a multiple disc clutch configured to drivingly engage and disengage a starter motor shaft and a pinion shaft. Certain ones of the discs have outer teeth that engage toothed channels in the motor shaft and certain other ones of the discs have inner teeth that engage toothed ribs on the pinion shaft. The discs, toothed channels and toothed ribs cooperate to cause axial engagement and disengagement of the freewheel unit with the motor shaft and pinion shaft.

18 Claims, 14 Drawing Figures

HELICAL SLIDING DRIVE STARTER

The invention relates to a helical sliding drive starter comprising a freewheel unit in the form of a multiple disc clutch assembly arranged between the starter motor shaft and the pinion shaft. The discs of the freewheel, which are provided with outer and inner teeth, engage, via these teeth, with toothed channels provided in the motor shaft and toothed ribs on the pinion shaft.

Known starters of this kind, which are preferably used for high-capacity starting motors since the multiple disc clutch permits adjustment of the maximum torque to be transmitted and therefore provides protection for the individual elements against the unavoidable impact loads occurring when operating the starter, require a relatively large amount of space for accommodating the starter housing since the sliding drive and the clutch have to be arranged separately from each other on the shaft. In particular, the length of the entire system that results from this separate arrangement does not permit its use for smaller starting capacities in connection with engines intended for small and medium-sized motor vehicles, in view of the production costs. The greater length also increases the danger of fracture due to vibration of the engine.

The object of the invention is to provide a helical sliding drive starter which, despite the use of a multiple disc clutch as the freewheel unit, is very short and is therefore suitable for very small capacities, avoids the danger of fracture due to vibration, and furthermore permits the use of components that are simple to produce and assemble.

This object is achieved by providing toothed channels defining threads in the starter motor shaft and toothed ribs defining a sliding screw thread on the pinion shaft extend along the shafts and cause axial engagement and disengagement of the discs of the freewheel unit. The starter motor shaft is expediently designed as a hollow shaft which receives the pinion shaft, toothed ribs, toothed channels and the discs are arranged in a longitudinal portion of the starter motor shaft that is surrounded by the armature laminations of the starter motor. The discs may have axial outwardly curved portions in the manner of spring washers, which face each other or alternate with planar discs. It is also possible for the pitch of the threads that are formed by the channels or ribs and that bring about the engagement and disengagement movement to be greater in the zone of the pressure side of the disc clutch than on the other side.

In this arrangement, the disc clutch and the thread-forming channels and ribs perform the function of the free-wheel unit as well as that of the feed thread. The ability to limit torque prevents impact loading of the pinion and the ring gear of the internal combustion engine and enables the components to be of smaller dimensions. Furthermore, the service life of the starter is considerably extended. The form of the discs enables the clutch to be disengaged more readily with less internal friction, and the variation in the pitch of the threads results in the discs separating from each other more rapidly when the pinion is overtaken by the ring gear of the flywheel of the internal combustion engine. If a suitably large number of discs are provided, the diameter of each disc can be kept so small that the clutch, even in the case of small-capacity starters, can be accommodated within the zone of the armature laminations and in the starter motor shaft of hollow form, as has previously been possible only in the case of starters of higher capacity and correspondingly large dimensions and when using normal disc clutches as freewheel units.

The starter motor housing may take the form of a cylindrical drawn part, one end of which, in the form of an annular flange, is extended in the form of a bearing block for receiving the bearing of the starter motor shaft, a conical sleeve, biased by a spring in the direction of the pinion, being slidably guided in the axial direction at the outer end of the bearing block, and the conical face of this sleeve bears against a conical sleeve mounted on the pinion shaft, the force of the spring being lower than that of the return spring of the pinion. In this way, before the pinion engages in the ring gear of the flywheel and after the pinion has again been returned, braking of the pinion shaft or of the pinion shaft and the motor armature is achieved. There is provided a further advantage that the starter motor housing is also closed at the drive side both in the rest position and the working position, and that, apart from the pinion, no movable parts of the starter are exposed to the effects of the surrounding atmosphere, so that the use of costly corrosion-resisting materials is not necessary.

The pole pieces of the starter motor may have bearing faces in the form of sections of a cylinder, which match the inner walls of the starter motor housing, and channels laterally holding these surfaces and extending parallel to the axis of the cylinder, in which channels can be clamped by shims in the form of sections of a cylinder and likewise matching the inner walls of the starter motor housing. The shims have projections, the ends of which engage the pole pieces and the oppositely disposed edges of which form slots parallel to the axis of the motor. The shims act as clamping elements between the pole pieces and, through the radial pressure components which they exert, hold the pole pieces in position in relation to the starter motor housing so that special screw connections or welded connections are unnecessary.

If the starter is provided with a dished magnetic switch housing mounted on the end face of the starter motor housing, then the core of the magnetic switch can be displaceable coaxially to the pinion shaft and held by a pair of axially spaced spring washers which are secured by their peripheral edges in the dished housing. One of the two spring washers can be rated to suit the full stroke of the core of the magnet and the other to suit part of this stroke. The spring washers may be formed as annular elements having slots extending substantially tangentially to the opening formed within the ring, or as annular elements having substantially S-shaped or arcuate connecting bridges between an inner and an outer portion of the annulus. This configuration and arrangement of the magnetic switch is rendered possible, even for small-capacity starters, by the fact that the pinion shaft of the arrangement in accordance with the invention is of very low weight which, in contrast to the normal arrangements, is not increased to any appreciable extent by the portion of a freewheel unit of normal size that rests on the pinion shaft. Furthermore, again in contrast to the known arrangements, the magnetic core does not require a high-precision close-tolerance guide in a block of non-magnetic material, in order to render the magnetic switch free from vibration.

In the above-described form of starter, the brush-holder boxes can be circumferentially offset from each other in pairs on guide arms, which are interconnected by a tensioning device and are pivotable about a pivot of fixed location and extending parallel to the axis of the collector, and at least those oppositely disposed inner walls of the brush-holder boxes that extend transversely of a radial plane through the axis of the collector are inclined outwardly towards the collector. In this arrangement, a pressure sufficient to ensure electrical contact is imparted to the brushes by the spring bias. The wear length of the brushes is thus greatly increased. An angled plate which can be fitted by means of bifurcated lugs into the slots formed in the oppositely disposed edges of the shims for the pole pieces can accommodate the pivot carrying the guide levers, and thus facilitate the fitting of the brush holder boxes into the starter motor housing.

The invention will now be described in greater detail by reference to embodiments illustrated in the drawing, in which.

Figure 5:
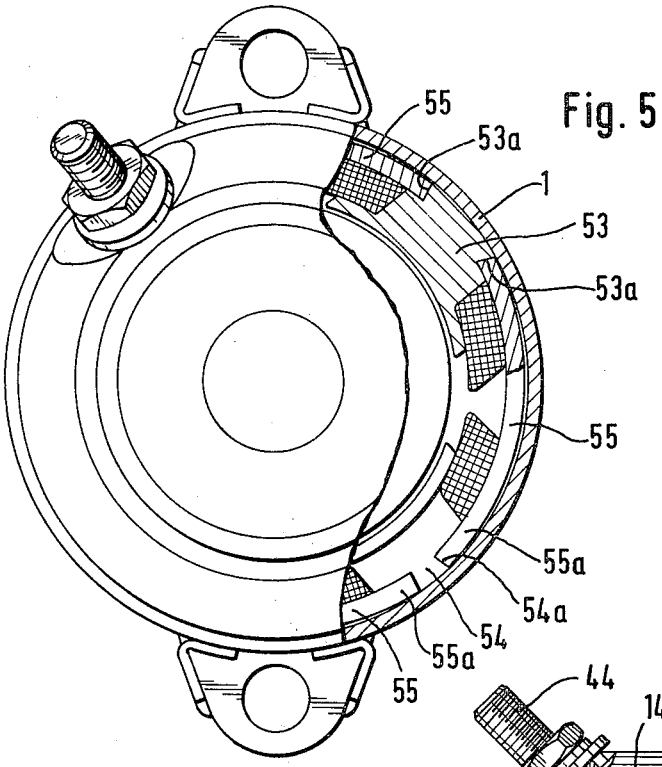
Figure 6:
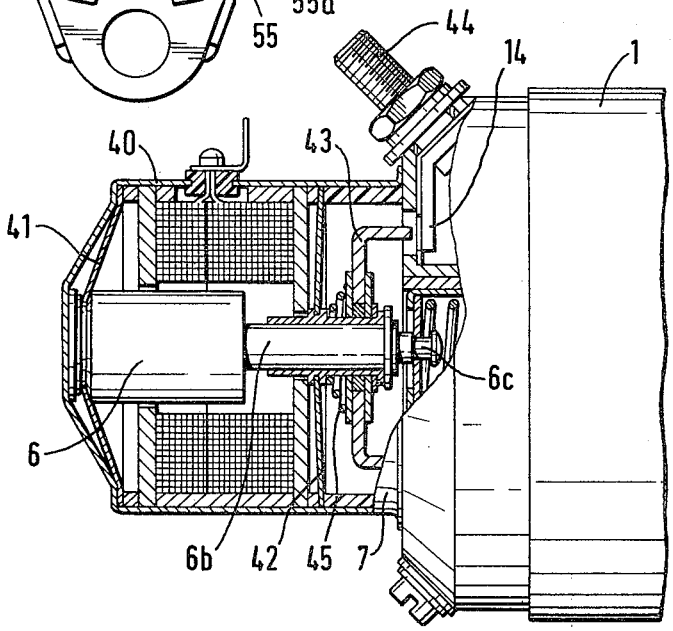
Figure 7:
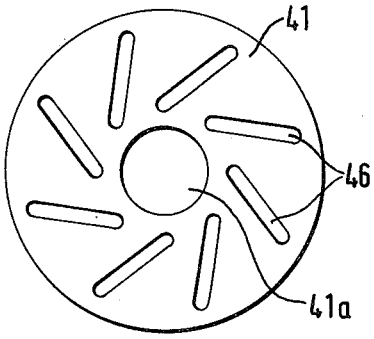
Figure 8:
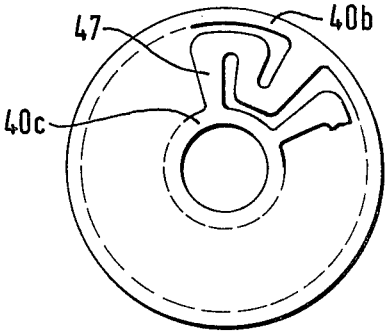
Figure 9:
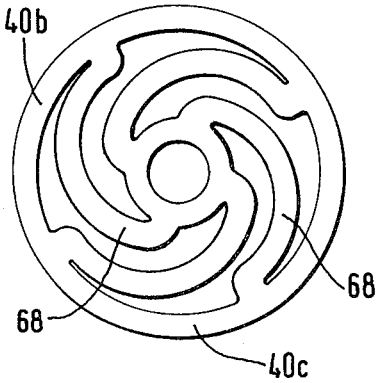
Figure 10:
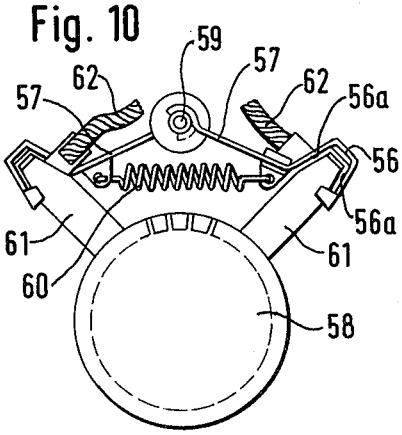
Figure 11:
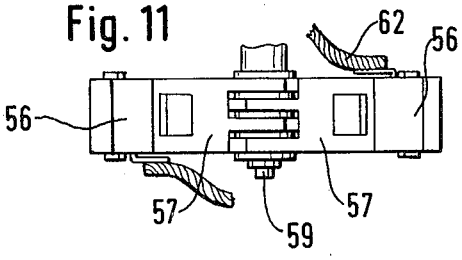
Figure 12:
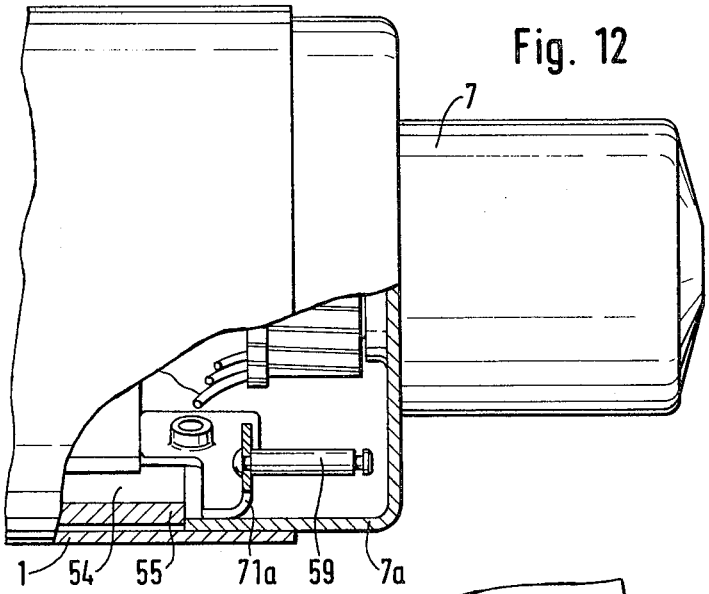
Figure 13:
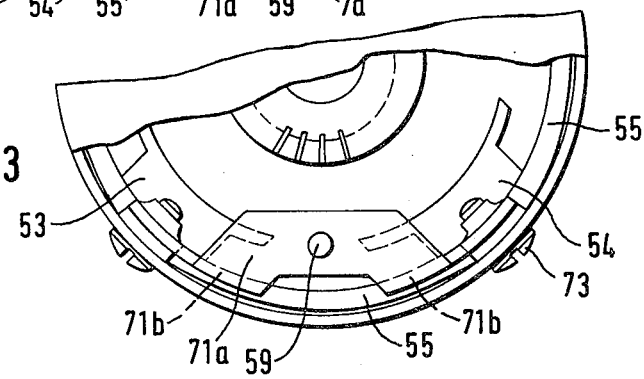
Figure 14:
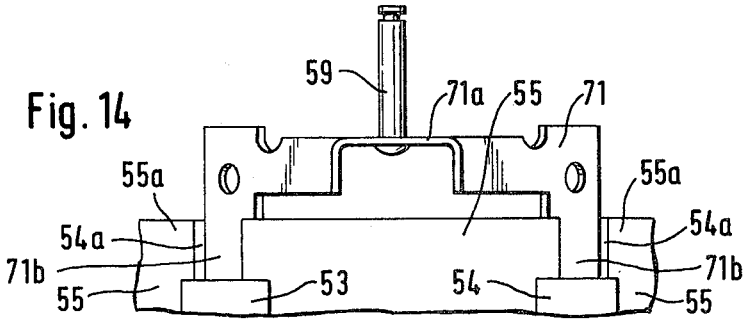

FIG. 5 is a rear end view (looking from left to right in FIG. 1) of the starter motor, a portion thereof being cut away, FIG. 6 is a partial sectional view of the rear end of the starter, with the magnetic switch, seen from the side, and partially cut away in the axial direction, FIGS. 7, 8 and 9 show individual parts of the magnetic switch, FIGS. 10 and 11 show the holding means for the brushes of the starter motor in radial section, FIG. 12 shows a detail of the brush holder means in the starter motor housing, FIG. 13 is a side view of the FIG. 12 detail, and FIG. 14 is a plan view related to FIG. 13.

Figure 1:
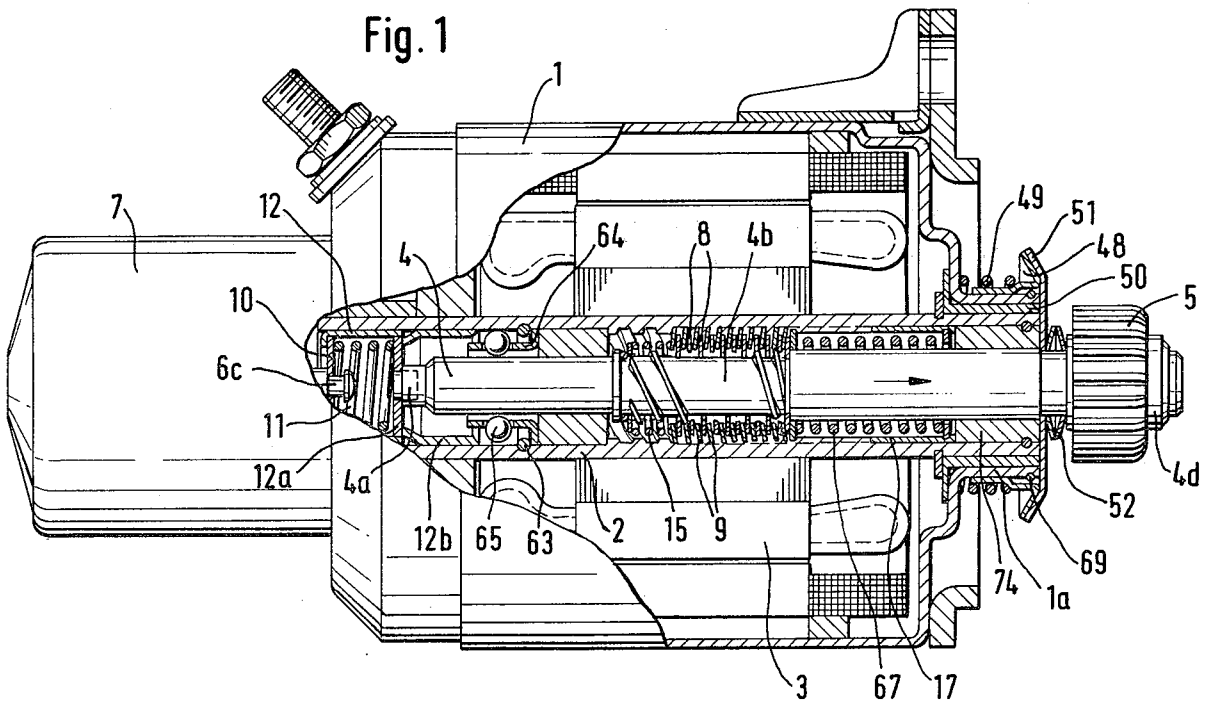
FIG. 1 shows a side view of the starter with portions thereof cut away.
Figure 2:
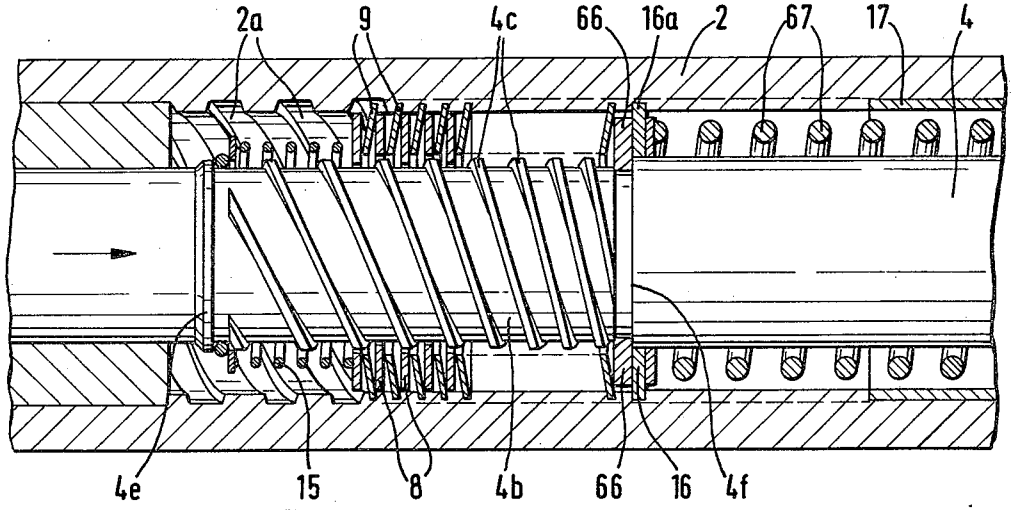
FIG. 2 shows, on a larger scale, a detail from FIG. 1.
Figure 3:
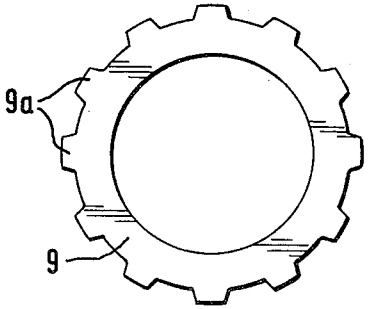
FIGS. 3 and 4 show individual parts of the multiple disc clutch.
Figure 4:
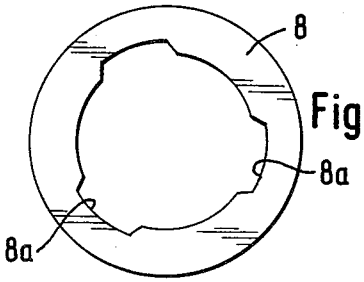

As can be seen from FIG. 1, the starter motor shaft 2 in the starter motor housing 1 is hollow. Mounted within this hollow shaft and axially displaceable therein is the pinion shaft 4. The pinion 5 is mounted on an enlarged end 4*d* of the pinion shaft 4. The annular base 12*a* of a slide sleeve 12, guided in the starter motor shaft 2, bears against the face of the reduced end 4*a* of the pinion shaft 4. Arranged in slide sleeve 12 is a biasing spring 11 which is loaded by the core lug 6*c* of the magnetic switch 7 by way of an annular disc 10. The slide sleeve 12 has a bushing-like extension 12*b* which, together with the reduced end 4*a* of the pinion shaft 4 and a ball guide sleeve 64, secured in the axial direction against the inner face of the starter motor shaft 2 by means of a snap ring 63, and the balls 65 guided by this sleeve, forms a lock for the pinion shaft 4 in its extreme feed position. The intermediate portion 4*b* of the pinion shaft 4, which is in the zone of the armature laminations 3 of the starter motor and is illustrated on an enlarged scale in FIG. 2, has tooth-shaped ribs 4*c* in the form of screw threads which engage in the tooth-shaped channels 8*a* of the discs 8 which here take the form of planar annular discs, one of which is shown in FIG. 4. The inner wall of the starter motor shaft 2 is provided with complementary tooth-shaped channels 2*a* which likewise extend along the shaft in the form of screw threads and in which engage the teeth 9*a* of the circular discs 9 which here have axial bent-out portions as in the case of spring washers. One of these discs 9 is shown separately in FIG. 3. The stack formed by the discs 8 and 9 is loaded, at the end remote from the pinion 5, by a cylindrical spring 15, backed by a collar 4*e*. The opposite end of the stack bears against an annular disc 66 which is backed by a shoulder 4*f* on the pinion shaft 4. Located at the other side of the annular disc 66 is a loose toothed ring 16, the teeth 16*a* of which engage in the channels 2*a* in the starter motor shaft 2. This toothed ring 16 is loaded by a return spring 67 which is backed by the bearing block 74 (see FIG. 1) of the pinion shaft 4. The distance of travel of the toothed ring 16 and therefore that of the pinion shaft 4 are limited by a stop block 17 inserted in the starter motor shaft 2.

The starter motor housing is formed by a cylindrical drawn part, one end of which (see FIG. 1) is in the form of an annular flange and continues as a bearing block 1*a* which receives the bearing 50 of the starter motor shaft 2. At the outer end of this bearing block 1*a* is an angled conical sleeve 48 which is guided to slide in the axial direction and is biassed towards the pinion 5 by a spring 49 which is backed by the end face of the starter motor housing 1. The movement of the conical sleeve 48 towards the pinion 5 is limited by a snap ring 69. The conical face of this sleeve 48 bears against a conical sleeve 51 which is mounted on the pinion shaft 4 and is under pressure from a pair of spring washers 52. In the starter motor housing 1, the pole pieces 53 and 54 of the starter motor (see FIG. 5) are provided with bearing faces which are in the form of portions of a cylinder and match the inner walls of the housing 1. These bearing faces are locked at their sides by channels 53*a* extending parallel to the axis of the cylinder. Clamped in these channels are the shims 55 which are in the form of sections of a cylinder and likewise match with the inner walls of the starter motor housing 1 and which have projections 55*a* which hold the pole pieces 53 and 54 by their end faces. The shims 55 have projections 55*a* (see also FIG. 14) which hold the pole pieces 53 and 54 by their end faces, the opposite edges of these projections forming slots 54*a* parallel to the axis of the motor. As shown in FIG. 6, the housing 40 of the magnetic switch 7 is mounted on the end face of the starter motor housing 1 and is of dished shape. The magnet core 6 is displaceable along the axis of the pinion shaft 4, (see FIG. 1). The magnet core 6 is held by a pair of axially spaced spring washers 41 and 42, which in turn are secured by their peripheral edges in the housing 40. One of the springs, i.e. the spring 41, is operative over the entire stroke of the magnet core 6, whereas the other, spring 42, is rated for a partial stroke which mainly applies the necessary pressure to the contact bridge 43 so as to establish connexion with the switching contact 14 of the impact terminal 44 of the starter motor. The contact bridge 43 is arranged on a cylindrical lug 6*b* of the magnetic core 6 and is axially displaceable thereon under the action of the spring 45. As shown in FIG. 7, the spring washers 40 and 41 have slots 46 extending tangentially of the hole 41*a*, or, as shown in FIGS. 8 and 9, they may have S-shaped or arcuate connecting portions 47 and 68 respectively extending between the outer edge portion 40*b* and the inner edge portion 40*c*, so that the washers are able to deflect to the required extent. As shown in FIGS. 10 and 11, the brush holder boxes 56 are offset circumferentially from each other and are arranged in pairs on guide arms 57, which can be swivelled jointly about an axis parallel to the axis of the commutator 58, and can be pulled towards each other by a spring 60 to form a wide angle. The mutually facing inner walls 56*a* of the brush holder box 56 incline outwardly towards the commutator 58. Thus, the ends of the brushes 61 that are located in the boxes apply adequate contact pressure under the action of the spring 60. Fitted at the ends of the brushes 61 is a correspondingly inclined contact plate made of high-conductivity material and having connecting cables 62 welded to it. The guide arms 57 are mounted on the spindle 59 and are insulated from each other. As shown in FIGS. 12, 13 and 14, this spindle is secured to an arm 71*a* of an angled sheet 71. The angled sheet 71 has two angled bifurcated attachments 71*b* which, prior to the insertion of the flange 7*a* of the housing of the magnetic switch 7 into the starter motor housing 7, are fitted into the slots 54*a* which are formed between the projections 55*a* of the shims 55 holding the pole pieces 53 and 54 (see FIG. 5). After the flange 7*a* of the housing of the magnetic switch 7 has been inserted, the angled plate 71 is secured to the housing wall by screws 73 accessible from the exterior.

After the magnetic switch (see FIG. 6) has been switched on, the magnetic core 6 moves in the direction of the arrow and in so doing presses the annular disc 10 against the biassing spring 11. This spring urges the slide sleeve 12 by its annular bottom 12*a* against the end of the reduced portion 4*a* of the pinion shaft 4 (see also FIG. 1). Even in the first phase of advance, the contact bridge 43, mounted on the magnetic core 6, closes the contacts 14 for switching on the starter motor, and as a result of rotation of the starter motor shaft 2 so caused (see also FIG. 2), the discs 9, guided in the coarse thread 2*a* of this shaft, move in the direction indicated by the arrow in FIG. 2; at the same time, because of the friction caused by the pressure of the cylindrical spring 15 and occurring between their outer faces and those of the discs 8 guided by the tooth-forming ribs 4*c* of the pinion shaft 4, said discs 9, together with the discs 8 on the tooth-shaped ribs 4*c* are compacted by a screwing action to form a stack of discs 8, 9 which moves into contact with the annular disc 66. Then, this stack of discs 8, 9, guided in the coarse pitch of the starter motor shaft 2 formed by the tooth-forming channels 2*a*, are further displaced in the direction of said arrow, together with the pinion shaft 4 now rigidly connected to the stack of discs 8, 9, this displacement continuing until the toothed ring 16 bears against the annular end-face of the stop block 17. During the compression of the stack of discs 8, 9, and because of the relative axial movement between the discs 8 and the pinion shaft 4, the pinion shaft, together with the pinion 5 will have advanced slowly, will have rotated and, finally after the stack of discs 8, 9 has moved into contact with the annular disc 66, will have been pushed rapidly into the end position and have rotated at the driving speed of the starter motor shaft 2. Under the pressure of the biasing spring 11, the sleeve-like attachment 12*b* of the slide sleeve 12 will, in this position of the pinion shaft 4, have pressed the balls 65 of the ball guide sleeve 64 radially inwards against the shoulder associated with the reduced portion 4*a* of the pinion shaft 4 and thus will have locked the pinion shaft 4 against axial movement. After the internal combustion engine has started up, the speed, transmitted by the gear ring (not illustrated) of its flywheel to the pinion shaft 4, catches up with the speed of the starter motor 2 with the result that the discs 8, mounted on the median portion 4*b* of the pinion shaft 4, move in the direction opposite to that indicated by the above-mentioned arrow in FIGS. 1 and 2, so that the stack of discs 8, 9 is opened up and the friction between the discs 8 and the discs 9 ceases. After the magnetic switch has been switched off, the pinion shaft 4 is moved back in the axial direction under the pressure of the return spring 67, and the sleeve attachment 12*b* of the slide sleeve 12 releases the balls 65. These move radially outwards from the reduced portion 4*a* on the pinion shaft 4 and return to their initial position, and the pinion shaft 4, together with the pinion 5, moves out of the ring gear (not illustrated) of the internal combustion engine and returns to the position illustrated in FIG. 1.

I claim:

1. A helical sliding drive starter comprising a freewheel unit having a multiple disc clutch arranged between a starter motor shaft and a pinion shaft, said motor shaft formed with tooth-shaped channels on an interior surface, said pinion shaft formed with tooth-shaped ribs on an exterior surface, certain ones of said discs are provided with outer teeth and certain other ones of said discs are provided with inner teeth, said outer teeth configured to engage said tooth-shaped channels formed in said motor shaft and said inner teeth configured to engage said tooth-shaped ribs on said pinion shaft, said tooth-shaped channels extend along said starter motor shaft in the form of screw threads, said tooth-shaped ribs extend along said pinion shaft in the form of a sliding screw thread, said discs, said screw threads, and said sliding screw thread interacting to cause axial engagement and disengagement of said freewheel unit with said motor shaft and said pinion shaft.

2. A helical sliding drive starter according to claim 1 wherein said starter motor shaft is designed as a hollow shaft which receives said pinion shaft, and the toothed ribs and the toothed channels, together with said discs are arranged in a longitudinal portion of said starter motor shaft that is surrounded by armature laminations of said starter motor.

3. A helical sliding drive starter according to claim 2 wherein a slide sleeve is guided in said starter motor shaft and contains a biasing spring which is loaded by a magnetic core of a magnetic switch by way of a first annular disc, an annular bottom of said slide sleeve acts upon an end of the pinion shaft that is remote from a pinion.

4. A helical sliding drive starter according to claim 3 including an necked attachment to said slide sleeve which, together with a reduced portion at said end of said pinion shaft, a ball guide sleeve secured axially in said starter motor shaft, and balls, form a device for locking said pinion shaft in an outermost feed position of said pinion.

5. A helical sliding drive starter according to claim 1 wherein a stack formed by said discs, is loaded on its face remote from said pinion by a cylindrical spring, backed by a collar on said pinion shaft, and bears by its side presented to said pinion against a second annular disc which is backed by a shoulder of said pinion shaft and the other side of which bears against a loose toothed ring which is biased by a return spring and engages said toothed channels of said starter motor shaft, the path of movement of said toothed ring in the axial direction being limited by a stop inserted in said starter motor shaft.

6. A helical sliding drive starter according to claim 1 wherein said other discs have portions bent out in the axial direction, as in spring washers, and are arranged in pairs with their bent out portions facing each other, said other discs alternate with said one discs.

7. A helical sliding drive starter according to claim 1 wherein the pitch of the threads of said toothed ribs and the corresponding toothed channels that bring about the engaging and disengaging movement is greater in the zone on the pressure side of said multiple disc clutch than at the other side.

8. A helical sliding drive starter according to claim 1 wherein a housing of said starter motor is formed by a cylindrical drawn part, one end of which is in the form of an annular flange and is extended as a bearing block for receiving a bearing of said starter motor shaft.

9. A helical sliding drive starter according to claim 8 including a first conical sleeve biased by a spring towards said pinion is guided to slide in the axial direction at the outer end of said bearing block, the conical surface of said first sleeve bears against a second conical sleeve mounted on said pinion shaft, the force exerted by said spring biasing said first sleeve being less than that exerted by said return spring for said pinion.

10. A helical sliding drive starter according to claim 9 wherein pole pieces of said starter motor have bearing faces in the form of sections of a cylinder which match the inner walls of said starter motor housing and have channels which extend parallel to the axis of the cylinder and laterally bound said bearing faces, in said housing channels can be clamped shims which are likewise in the form of sections of a cylinder and match the inner walls of said starter housing.

11. A helical sliding drive starter according to claim 10 wherein said shims have projections which hold said pole pieces at their ends, the oppositely disposed edges project therefrom and form slots parallel to the axis of said starter motor.

12. A helical sliding drive starter according to claim 11 including a magnetic switch having a dished housing mounted on one end face of said motor starter housing, a core of said magnet switch is displaceable along the axis of said pinion shaft and is held by a pair of spring washers which are axially spaced from each other and are secured at their peripheral edges in said dished housing.

13. A helical sliding drive starter according to claim 12 wherein one of said spring washers is rated for the full stroke of said magnetic core, and the other of said spring washers is rated for a partial stroke.

14. A helical sliding drive starter according to claim 12 wherein said spring washers are in the form of discs having slots extending substantially tangentially to a central hole formed in said spring washers.

15. A helical sliding drive starter according to claim 12 wherein said spring washers are formed as discs having substantially S-shaped arcuate connecting bridges between inner and outer annular portions.

16. A helical sliding drive starter according to claim 12 including brush holder boxes angularly offset from each other in pairs and arranged on guide arms which are swivellable about a pivot extending parallel to the axis of a commutator of said motor, and are interconnected by a tension spring.

17. A helical sliding drive starter according to claim 16 wherein at least inner walls of said brush holder boxes that extend transversely of a radial plane of the axis of said commutator are outwardly inclined towards said commutator.

18. A helical sliding drive starter according to claim 16 including an angled plate which can be inserted into said slots formed by said pole pieces by means of bifurcated attachments and which carries said guide arms.

* * * * *